US005384558A

United States Patent [19]

Maruhashi

[11] Patent Number: 5,384,558

[45] Date of Patent: Jan. 24, 1995

[54] RADIO-FREQUENCY INTEGRATED CIRCUIT DEVICE HAVING ADJUSTABLE MATCHING CIRCUIT

[75] Inventor: Kenichi Maruhashi, Tokyo, Japan

[73] Assignee: NEC Corporation, Tokyo, Japan

[21] Appl. No.: 251,425

[22] Filed: May 31, 1994

[30] Foreign Application Priority Data

May 31, 1993 [JP] Japan ..... 5-129186

[51] Int. Cl.[6] ..... H01P 5/00

[52] U.S. Cl. ..... 333/33; 333/246

[58] Field of Search ..... 333/104, 33, 246, 247, 333/262; 330/53, 56, 286

[56] References Cited

U.S. PATENT DOCUMENTS 4,618,838 10/1986 Kajiwara et al. ..... 333/33
4,754,229 6/1988 Kawakami et al. ..... 333/33 X
5,065,117 11/1991 Yoshimasu ..... 333/33

FOREIGN PATENT DOCUMENTS 63-224503 9/1988 Japan .
46001 2/1990 Japan ..... 333/33

*Primary Examiner*—Paul Gensler
*Attorney, Agent, or Firm*—Young & Thompson

[57] ABSTRACT

A radio-frequency integrated circuit has a transmission line which is short-circuited at an RF short-circuiting point to ground through an RF short-circuiting and DC blocking capacitor. The transmission line is connected to a bias supply point. The circuit has a matching circuit constituted by the transmission line and has a short-circuit stub and an adjusting capacitor. The short-circuit stub has first bonding points to which the bias voltage is applied and the adjusting capacitor has second bonding points which are selectively wire-bonded with the first bonding points. By selecting the positions at which the bonding points are interconnected, the impedance of the matching circuit can be adjusted.

7 Claims, 3 Drawing Sheets

RADIO-FREQUENCY INTEGRATED CIRCUIT DEVICE HAVING ADJUSTABLE MATCHING CIRCUIT

BACKGROUND OF THE INVENTION (1) Field of the Invention

The present invention relates to a semiconductor integrated circuit device, and more particularly to a radio-frequency integrated circuit device having an adjustable matching circuit.

(2) Description of the Related Art

A conventional short-circuit stub which is used in a semiconductor integrated circuit device and to which a bias voltage is applied is configured as shown, for example, in FIGS. 1A and 1B. FIG. 1B shows this in an equivalent circuit diagram. A signal line 1 is short-circuited to ground 3 at an RF short-circuit point 6 through a capacitor 2, while it is supplied with a direct current (DC) voltage from a biasing point 4. That is, the capacitor 2 operates to effect RF short-circuiting and, at the same time, serves to block a direct current component.

The actual parameters of elements within the fabricated integrated circuit result in values different from those originally designed due to distributed capacitance or distributed inductance. Thus, there occur cases such integrated circuit lacks optimum properties. There have been attempts to make the circuit adjustment by adjusting a matching circuit after the fabrication of the integrated circuit.

In a conventional micro-strip line matching circuit shown as an example in FIG. 2, a micro-strip transmission line 10 and island-like metal lands 11 disposed adjacent thereto are interconnected by bonding wires 12, thus effecting changes in impedance and making appropriate adjustments in the electric characteristics. This functions in the same way as in the case wherein open stubs are provided in a matching circuit, and can be used irrespective of whether a bias voltage is applied or not.

An example wherein an adjustable matching circuit having a chip capacitor and a microstrip line is formed on a dielectric substrate has been disclosed in Japanese Patent Application Kokai Publication No. Sho 63-224503. In this example, there is involved an operation of moving a chip capacitor provided to interconnect the two lines disposed in parallel so that the position at which the signals pass through the chip capacitor is changed. In this case, there develops a change also in the impedance of the circuit comprising the two lines and the chip capacitor. In this example, the chip capacitor plays a role of blocking DC components and changing the impedance of the matching circuit.

In the prior art, it was difficult to provide integrally on the same substrate an adjustable matching circuit having a short-circuit stub to which a bias voltage is applied. Especially, in the case of a matching circuit constituted by coplanar lines, a problem was that, since the lines are surrounded by ground potential surface, the method of interconnecting the island-like lands as explained above was not suitable. Also, in the method wherein a chip capacitor is used, since it is on the premise that an external component is to be incorporated in the circuit, this has presented a problem in the enhancement of integration.

SUMMARY OF THE INVENTION

An object of the invention, therefore, is to overcome the problems existing in the prior art and to provide an improved radio-frequency integrated circuit device whose characteristics are optimized by the adjustment of impedance of a matching circuit.

According to one aspect of the invention, there is provided a radio-frequency integrated circuit device having a matching circuit constituted by a transmission line on a substrate, the matching circuit comprising:

a short-circuit stub to which a bias voltage is applied, the short-circuit stub being short-circuited to ground through a capacitor; and an adjusting capacitor which is disposed adjacent to the short-circuit stub, a first electrode of which is grounded and a second electrode of which is connected to the short-circuit stub by a bonding-wire.

In the circuit device according to the invention, independently of the RF short-circuiting and DC blocking capacitor as in the prior art circuit shown in FIG. 1, there is provided an additional adjusting capacitor which is disposed adjacent to the short-circuit stub and one of two electrodes of which is grounded in advance. The other electrode thereof is short-circuited to the ground radio-frequency wise internally of the adjusting capacitor, so that it is not affected even where the DC bias is applied.

By making wire-connection with the additional adjusting capacitor at any desired position of the short-circuit stub, the RF short-circuit point can be provided at any desired position. This in effect is the same as changing the effective length of the short-circuit stub, and enables to effect the adjustment of the matching circuit.

In the radio-frequency integrated circuit device according to the invention, in which the matching circuit is constituted by the transmission lines on the substrate, it is possible to optimize the characteristics of the integrated circuit device by using wire-bonding connections after the fabrication of the integrated circuit device. The matching circuit according to the invention may be constituted by either coplanar lines or microstrip lines.

The invention enables to reduce fabrication steps which are otherwise necessary due to redesigning or refabrication. Where the invention is applied to quantity production, the production yield is effectively enhanced since the effective length of the short-circuit stub can be easily and effectively adjusted.

BRIEF DESCRIPTION OF THE DRAWINGS

The above and other objects, features and of the present invention will be apparent from the following description of preferred embodiments of the invention explained with reference to the accompanying drawings, in which.

PREFERRED EMBODIMENTS OF THE INVENTION

Figure 1A:
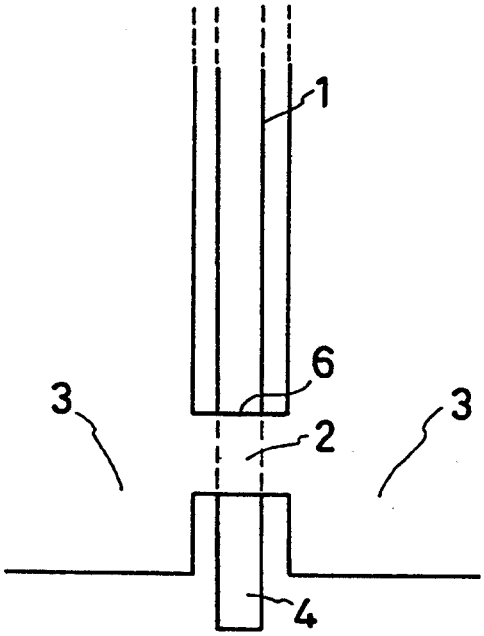
FIG. 1A PRIOR ART
FIG. 1A is a diagram showing a terminating portion of a conventional short-circuit stub in a matching circuit constituted by a coplanar transmission line.
Figure 1B:
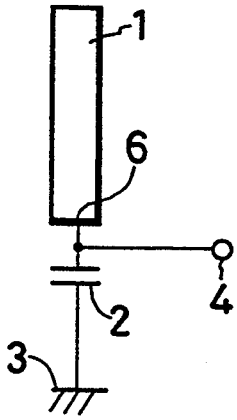
FIG. 1B PRIOR ART
FIG. 1B is an equivalent circuit diagram showing the arrangement of FIG. 1A.
Figure 2:
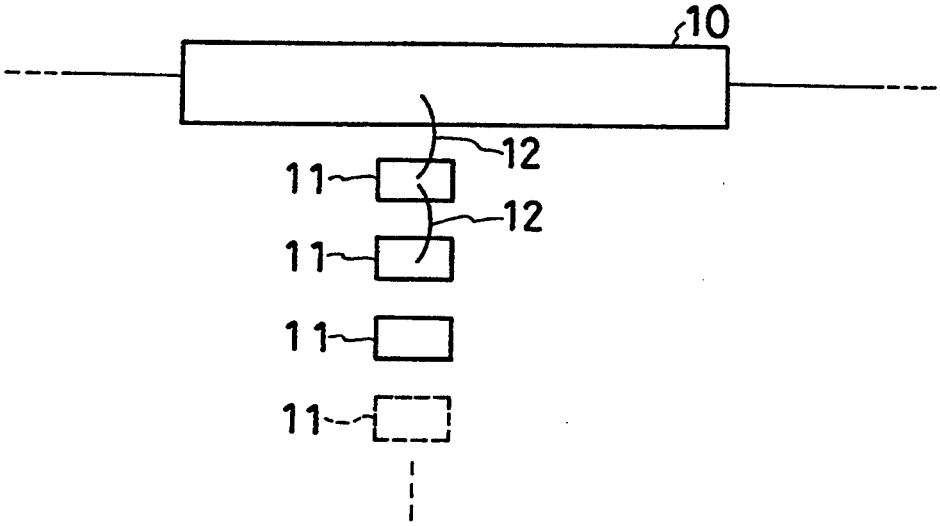
FIG. 2 PRIOR ART
FIG. 2 is a diagram for explaining a method for changing impedance in a conventional microstrip transmission line.

Now, preferred embodiments of the invention are explained with reference to the accompanying drawings. In the following description, the same reference numerals refer to the same or like elements in all the figures of the drawings.

Figure 3A:
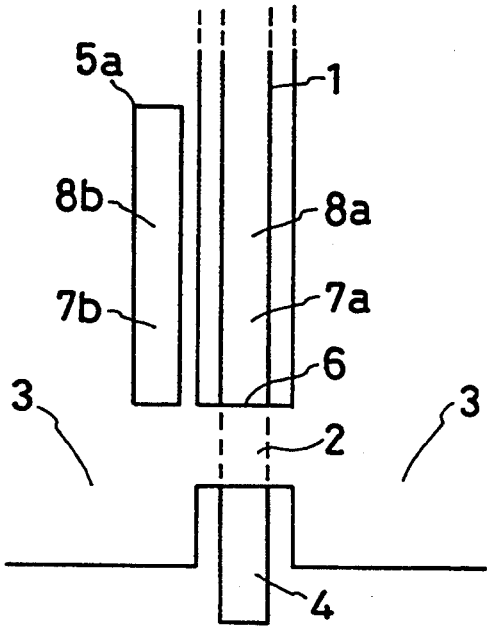
FIG. 3A is a diagram showing a terminating portion of a short-circuit stub in a matching circuit constituted by a coplanar transmission line of a first embodiment according to the invention.
Figure 3B:
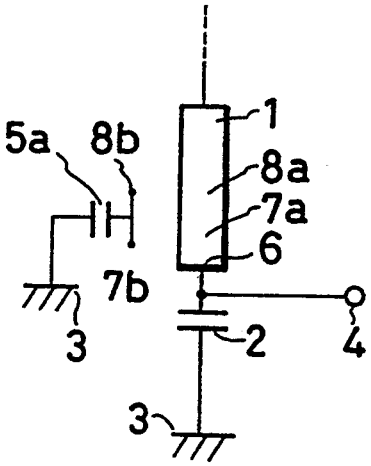
FIG. 3B is an equivalent circuit diagram showing the arrangement of FIG. 3A.

FIGS. 3A and 3B diagrammatically show a portion of a radio-frequency circuit of a first embodiment according to the invention. FIG. 3A shows a terminating portion of a short-circuit stub in a matching circuit constituted by a coplanar signal line. A signal line 1 is short-circuited radio-frequency wise to the ground 3 through a capacitor 2. This signal line 1 is connected to a bias supply point 4. A capacitor 5*a* disposed adjacent to the signal line 1 is formed on the ground surface 3, in which the ground surface 3 is utilized as it is as one of two electrodes of the capacitor 5*a*. FIG. 3B shows, in an equivalent circuit diagram, the arrangement shown in FIG. 3A.

The terminating portion of the short-circuit stub is located first at an RF short-circuit point 6. If, for example, a bonding point 7*a* of the signal line 1 and a bonding point 7*b* of the capacitor 5*a* are interconnected or wire-bonded, the effective length of the short-circuit stub is reduced accordingly. If a bonding point 8*a* and a bonding point 8*b* are wire-bonded, the effective length of the short-circuit stub is further reduced.

In this first embodiment, the wire-bonding method is used to adjust the effective length of the short-circuit stub in the matching circuit, and this adjustment enables to optimize the characteristics of the integrated circuit device.

Figure 4A:
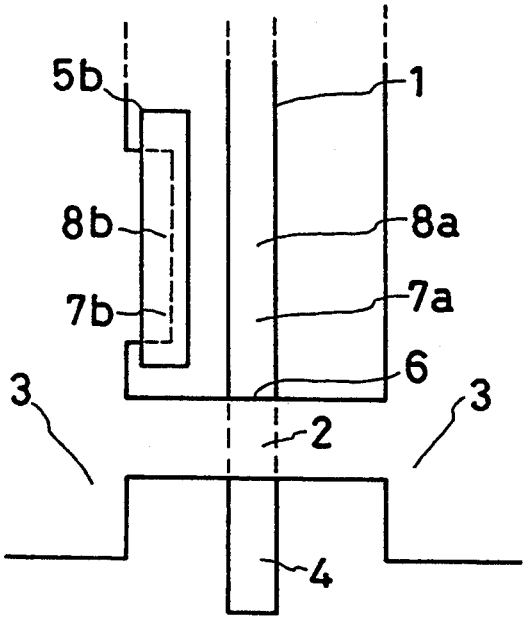
FIG. 4A is a diagram showing a terminating portion of a short-circuit stub in a matching circuit constituted by a coplanar transmission line of a second embodiment according to the invention.
Figure 4B:
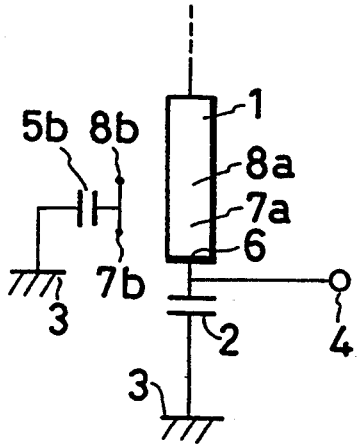
FIG. 4B is an equivalent circuit diagram showing the arrangement of FIG. 4A.

FIGS. 4A and 4B show an arrangement of an RF adjustment circuit of a second embodiment according to the invention. FIG. 4A shows a terminating portion of the short-circuit stub in the matching circuit constituted by a coplanar line. The signal line 1 is short-circuited radio-frequency wise to the ground surface 3 through a capacitor 2. Also, the signal line 1 is connected to a bias supply point 4. One of electrodes of a capacitor 5*b* which is disposed near the signal line 1 is connected to the ground 3. FIG. 4B shows, in an equivalent circuit diagram, the arrangement shown in FIG. 4A.

The terminating portion of the short-circuit stub is located first at an RF short-circuit point 6. If, for example, a bonding point 7*a* of the signal line 1 and a bonding point 7*b* of the capacitor 5*b* are wire-bonded, the effective length of the short-circuit stub is reduced. If a bonding point 8*a* and a bonding point 8*b* are wire-bonded, the effective length of the short-circuit stub is further reduced.

In this second embodiment, too, the wire-bonding is used to adjust the effective length of the short-circuit stub in the matching circuit, and this adjustment enables to optimize the characteristics of the integrated circuit device.

Figure 5A:
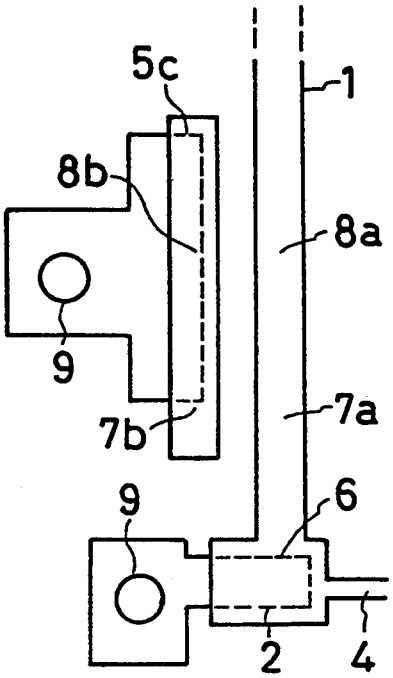
FIG. 5A is a diagram showing a terminating portion of a short-circuit stub in a matching circuit constituted by a microstrip line of a third embodiment according to the invention.
Figure 5B:
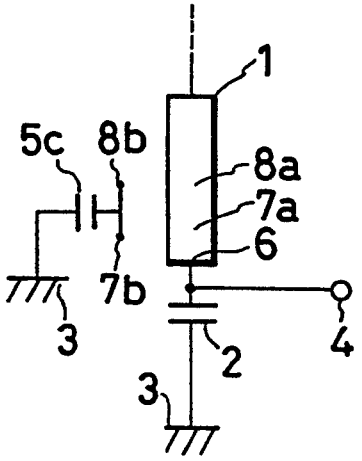
FIG. 5B is an equivalent circuit diagram showing the arrangement of FIG. 5A.

FIGS. 5A and 5B show an arrangement of an RF circuit device of a third embodiment according to the invention. FIG. 5A shows a terminating portion of the short-circuit stub in the matching circuit constituted by a microstrip line. The signal line 1 is short-circuited radio-frequency wise to the ground at the back through a capacitor 2 and a through-hole 9. Also, the signal line 1 is connected to a bias supply point 4. One of electrodes of a capacitor 5*c* which is disposed near the signal line is connected to the ground at the back through the through-hole 9. FIG. 5B shows, in an equivalent circuit diagram, the arrangement shown in FIG. 5A.

The terminating portion of the short-circuit stub is located first at an RF short-circuit point 6. If, for example, a bonding point 7*a* of the signal line 1 and a bonding point 7*b* of the capacitor 5*c* are wire-bonded, the effective length of the short-circuit stub is reduced. If a bonding point 8*a* and a bonding point 8*b* are wire-bonded, the effective length of the short-circuit stub is further reduced.

In this third embodiment, too, the wire-bonding is used to adjust the effective length of the short-circuit stub in the matching circuit, and this adjustment enables to optimize the characteristics of the integrated circuit device.

Figure 6:
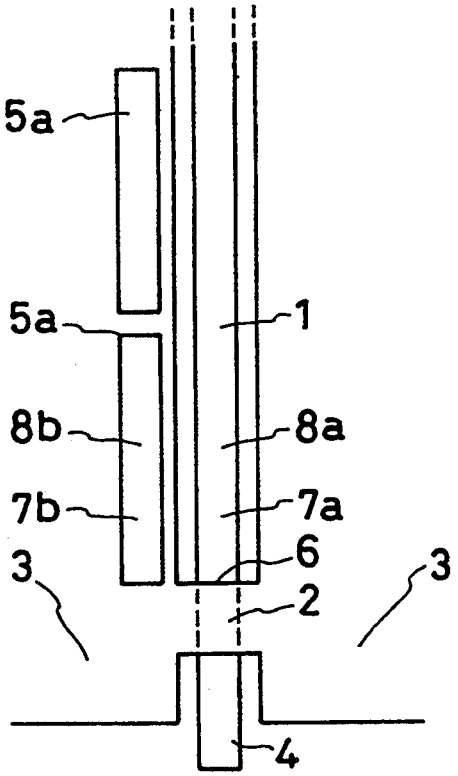
FIG. 6 is a diagram showing a modified matching circuit of FIG. 3A, in which a plurality of adjusting capacitors are provided at one side of the short-circuit stub.
Figure 7:
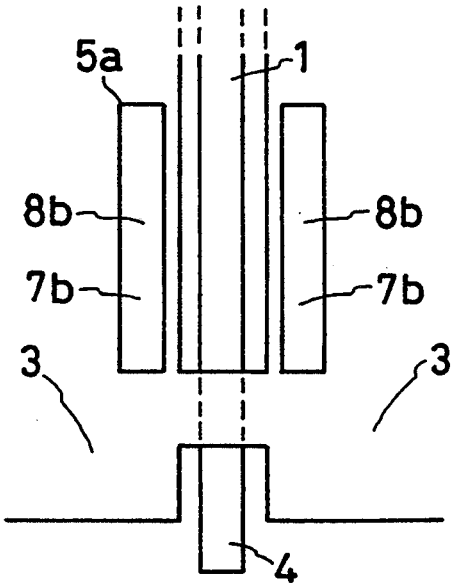
FIG. 7 is a diagram showing another modified matching circuit of FIG. 3A, in which a plurality of adjusting capacitors are provided at both sides of the short-circuit stub.

In each of the above three embodiments, the adjustment capacitor 5*a*, 5*b* or 5*c* has been exemplified as being a single capacitor but it is of course possible to provide a plurality of capacitors at one side of the signal line 1 as shown in FIG. 6. Also, it will be possible to provide such capacitors at both sides of the signal line 1 as shown in FIG. 7, rather than at one side.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A radio-frequency integrated circuit device having a matching circuit constituted by a transmission line on a substrate, said matching circuit comprising:

a short-circuit stub to which a bias voltage is applied, said short-circuit stub being short-circuited to ground through a capacitor; and an adjusting capacitor which is disposed adjacent to said short-circuit stub, a first electrode of which is grounded and a second electrode of which is connected to said short-circuit stub by a bonding-wire.

2. A radio-frequency integrated circuit device according to claim 1, in which said first electrode of said adjusting capacitor is formed by a ground potential surface.

3. A radio-frequency integrated circuit device according to claim 1, in which said first electrode of said adjusting capacitor is connected to a ground potential surface through a through-hole provided in the substrate.

4. A radio-frequency integrated circuit device according to claim 1, in which said short-circuit stub comprises a coplanar transmission line.

5. A radio-frequency integrated circuit device according to claim 1, in which said short-circuit stub comprises a microstrip line.

6. A radio-frequency integrated circuit device according to claim 1, in which a plurality of said adjusting capacitors are provided at one side of said short-circuit stub.

7. A radio-frequency integrated circuit device according to claim 1, in which a plurality of said adjusting capacitors are provided at both sides of said short-circuit stub.

* * * * *